US005468537A

United States Patent [19]

Brown et al.

[11] Patent Number: 5,468,537

[45] Date of Patent: Nov. 21, 1995

[54] PROTECTIVE GARMENTS COMPRISING AN OUTER SHELL FABRIC OF WOVEN ARAMID FIBERS WHICH ELONGATE WHEN EXPOSED TO A FLAME

[75] Inventors: Gary G. Brown, Wilmington, Del.; Hamid M. Ghorashi, Midlothian, Va.; Donald E. Shaffer, Wilmington, Del.

[73] Assignee: E. I. du Pont de Nemours and Company, Wilmington, Del.

[21] Appl. No.: 128,432

[22] Filed: Sep. 30, 1993

[51] Int. Cl.[6] ..... B32B 3/06; B32B 5/02; D03D 3/00; B27N 9/00

[52] U.S. Cl. ..... 428/101; 428/229; 428/236; 428/252; 428/302; 428/902; 428/920

[58] Field of Search ..... 428/229, 245, 428/246, 286, 101, 252, 302, 902, 920

[56] References Cited

U.S. PATENT DOCUMENTS

| | | | |
|---|---|---|---|
| 4,034,417 | 7/1977 | Ellis | 2/81 |
| 4,162,346 | 7/1979 | Jones, Jr. et al. | 428/364 |
| 4,194,041 | 3/1980 | Gore et al. | 428/315 |
| 4,849,280 | 7/1989 | Coombs | 428/233 |
| 5,001,783 | 3/1991 | Grilliot et al. | 2/81 |
| 5,274,849 | 3/1992 | Grilliot et al. | 2/81 |
| 5,336,734 | 8/1994 | Bowen et al. | 525/420 |

OTHER PUBLICATIONS

Scientific and Production Association, Chimvolokno.

*Primary Examiner*—James D. Withers

[57] ABSTRACT

Heat flow through a protective garment is reduced if the shell is a woven fabric extends laterally and expands away from the wearer upon exposure to a high heat flux.

8 Claims, 2 Drawing Sheets

PROTECTIVE GARMENTS COMPRISING AN OUTER SHELL FABRIC OF WOVEN ARAMID FIBERS WHICH ELONGATE WHEN EXPOSED TO A FLAME

BACKGROUND OF THE INVENTION

This invention relates to protective garments primarily for firefighters but which are also useful in industrial applications where workers may be exposed to very high heat flux. The garments, which include coats, jackets and/or pants, provide-protection against heat by reducing heat flow from the source to the body.

A great variety of garments which offer protection against heat are in use today. Most turnout gear commonly used by firefighters in the United States, comprise three layers, each performing a distinct function. There is an outer shell fabric often made from fiber of poly(m-phenylene isophthalamide) (MPD-I) and at times in combination with another heat and flame resistant fiber such as fiber from poly(p-phenylene terephthalamide) (PPD-T) or polybenzimidazole (PBI). Adjacent the outer shell is a moisture barrier. A laminate of Gore-Tex PTFE membrane with a fibrous nonwoven MPD-I/PPD-T substrate, or a laminate of Neoprene® with an MPD-I fibrous nonwoven is often employed for this purpose. Adjacent the moisture barrier, a thermal liner which generally comprises a batt of heat resistant fiber is used.

The outer shell serves to provide flame protection and serves as a primary defense. A thermal liner and a moisture barrier behind the outer shell offer comfort and protect against heat stress. The present invention focuses on a novel outer shell fabric which upon exposure to a high heat flux provides an additional significant margin of protection by changes in the garment fabric that reduce heat flow to the wearer.

THE DRAWING

SUMMARY OF THE INVENTION

This invention provides a multilayer garment that offers protection against heat and flame comprising, in order, a flame-resistant outer shell, a moisture barrier, and a thermal insulating liner, said outer shell comprising a woven fabric that extends laterally and expands away from the moisture barrier within about 3 seconds after exposure to a heat source of at least 1.8 cal/cm$^2$-sec.

DETAILED DESCRIPTION OF THE INVENTION

Protective garments contemplated by the present invention are generally similar in construction to those in use today. The important difference insofar as the present invention is concerned resides in the substitution for the shell of the prior art construction, a fabric layer that extends laterally within about 3 seconds after exposure to a heat source of at least 1.8 Cal/cm$^2$-seconds. The expansion causes an air pocket to form which improves the overall heat resistance of the garment.

Figure 1:
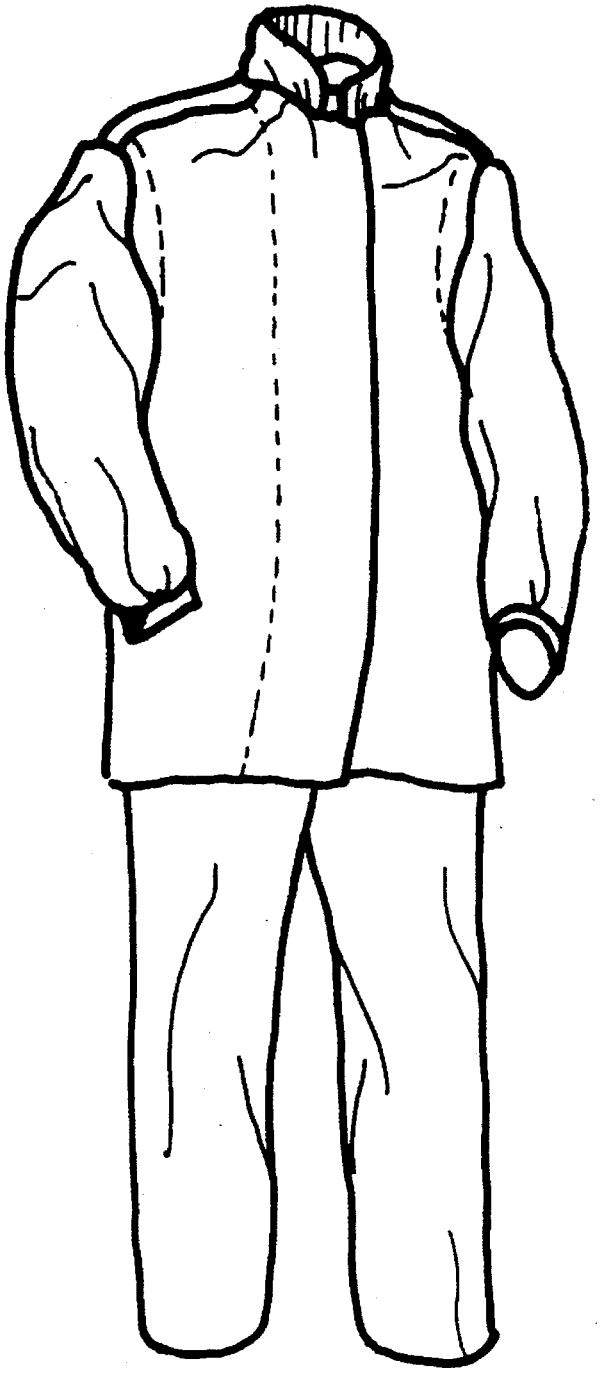
FIG. 1 is a schematic of a protective garment, more particularly, a turnout coat and trousers of the type worn by firefighters.
Figure 2:
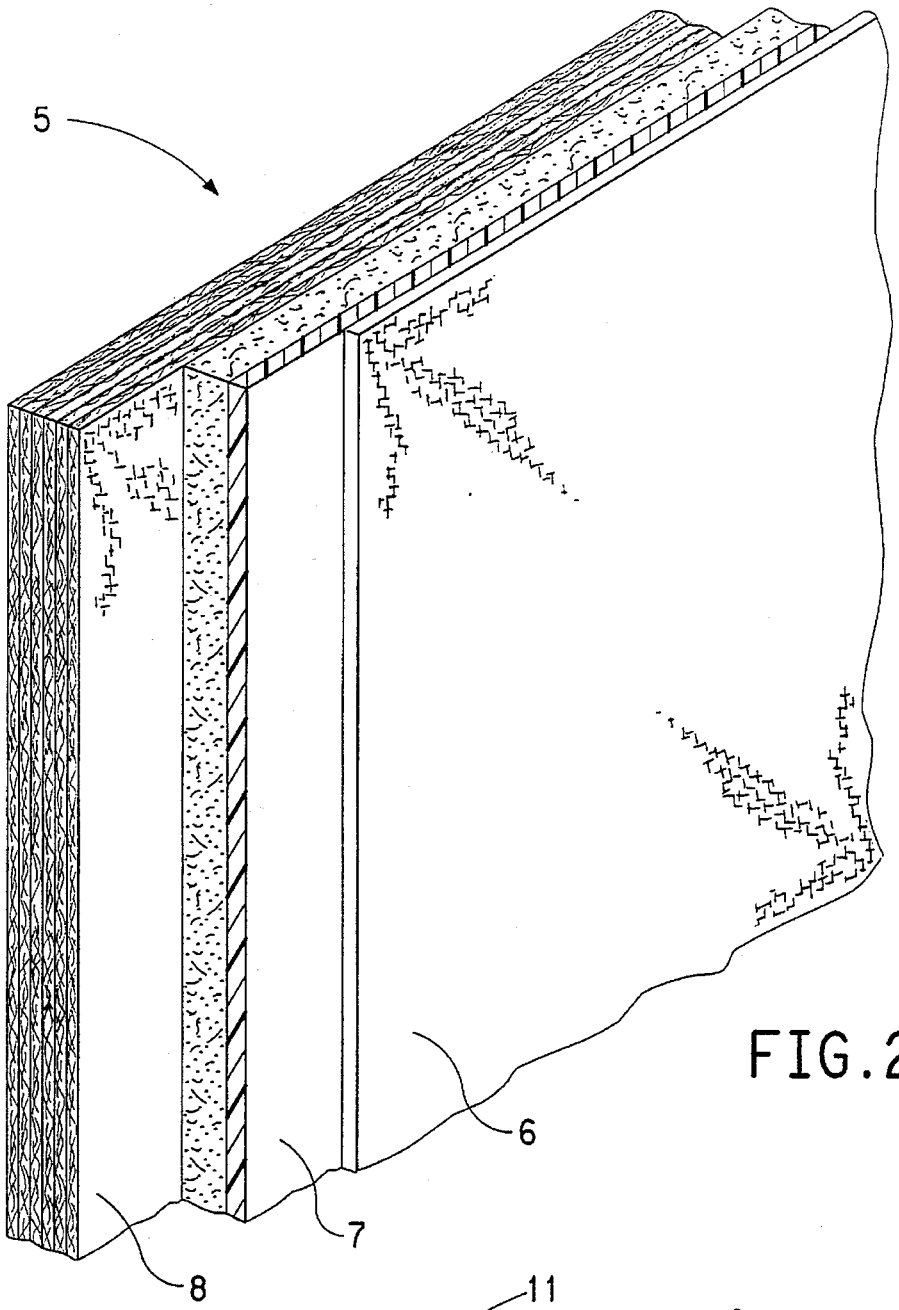
FIG. 2 is a schematic of multi-layer fabric in accordance with the present invention.

Typical turnout coats are constituted, at least in part, by a multi-layer fabric that is made up of three layers of materials each having different functions in the protective garment. Referring to FIG. 2 of the drawings, 5 is an enlarged diagrammatic view of a portion of a protective garment in accordance with this invention. The fabric unit comprises an outer shell 6, a moisture barrier layer 7 immediately adjacent thereto and a thermal liner layer 8. As used in a protective garment such as a firefighter's turnout gear, FIG. 1, these layers will be somewhat constrained by seams at least along the edges of the garment, however it is important that the shell layer be free for limited movement relative to the adjacent layer. The entire garment is preferably constituted by this multi-layered fabric but at least those portions that must provide protection against intense heat and flame should be.

The function of the moisture barrier is to provide a waterproofness while permitting transfer of water vapor. A moisture barrier layer commonly employed is a laminate of about 0.5 to 0.8 oz/yd$^2$ polytetrafluoroethylene film (GortexR from W. L. Gore & Assoc. Inc.) with a nonwoven substrate of MPD-I/PPD-T fiber having a basis weight of from about 2.5 to 3.5 oz/yd$^2$. The moisture barrier also serves as the back wall of the cavity when the outer shell expands in response to a high heat flux.

Adjacent the moisture barrier layer is a thermal insulating liner layer the purpose of which is to further reduce heat flow to the wearer. It normally has a basis weight of from 6.5 to 10.5 oz/yd$^2$ and comprises combinations of woven and/or non-woven fabrics or batts of heat resistant fibers such as MPD-I, PPD-T or PBI fiber.

The shell or outer layer of the multi-layer fabric is a woven fabric that extends laterally within 3 seconds after exposure to a heat source of at least 1.8 cal/cm$^2$-seconds The shell is preferably a tightly woven fabric having a basic weight preferably in the range of from about 4 to 8 oz/yd$^2$. As is known to those in the art, a tight weave is preferred because it provides a better barrier to hot gases which could more readily penetrate a loose weave. The upper basis weight limits of the various layers are not critical. They are generally governed by the requirement that the garment not be too heavy or stiff for comfort.

The shell is woven from spun (staple fiber) yarn which preferably ranges from 16/2 cc (cotton count) to 40/2 cc. For use in the shell fabric, the yarn selected is one that elongates preferably at least 1%, upon exposure to a butane flame as described below and has a Limiting Oxygen Index (L.O.I.) greater than 20, that is, it will not burn in air upon removal of flame. At least 75% and preferably the entire shell fabric, is woven from such yarns. As suitable fiber for such yarns there may be employed a fiber of sulfonated poly(p-phenylene terephthalamide) having an inherent viscosity of about 1.5 to 4, a tenacity of 3.5 to 5.5 gpd, a modulus of from 100 to 160 gpd and which contains from 5 to 20 mols of sulfur, as sulfonate groups, per 100 mols of polymer repeat units (see copending and coassigned U.S. patent application Ser. No. 08/047,394, filed Apr. 19, 1993). Another example of a suitable fiber is a polyarylene-1,3,4-oxadiazole known as Oxalon. The fibers have an L.O.I. greater than 20.

The multi-layer fabric may be a loose assembly of the layers or the layers may be attached by stitching or by other means. The benefits of the invention are achieved as a result of the lateral extension of the shell layer upon exposure to the high heat flux. As the layer extends laterally, it balloons away from the adjacent moisture barrier by virtue of the fact that the outer shell, or at least most of it, presents a convex surface. As it balloons, one or more air pockets form which provide additional resistance to heat flow and protection to the wearer over that which would be expected from the various layers. For this reason it is important that the shell be free to expand away from the adjacent fabric layer at least to some extent when exposed to high heat flux. The degree to which the yarn of the fabric elongates is not critical, since even a slight elongation will cause fabrics made from such yarns to balloon. For a significant ballooning effect it is preferable that the yarn elongation measured as described below exceed about 1%.

Tests and Measurements

Figure 3:
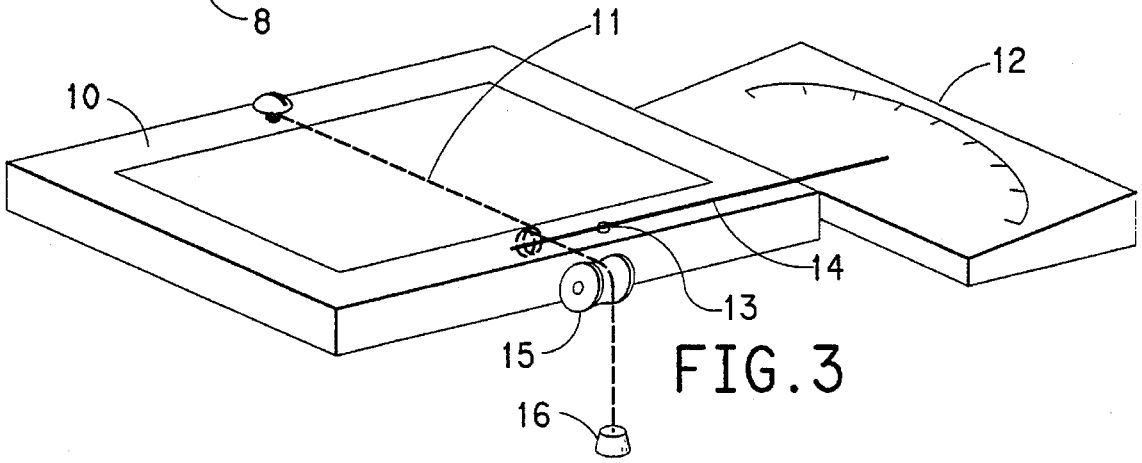
FIG. 3 is a schematic of a test apparatus for measuring yarn elongation.

Elongation of a spun yarn is measured using the apparatus of FIG. 3 by fixing an end of the yarn 11 (about 12 inches in length) to one side of a horizontally fixed, four inch square frame 10, looping the yarn around the end of a wire 14 which is pivoted on the opposing side of the frame about ¼ inch from the yarn and allowing the remainder of the yarn to hang over a pulley 15 located adjacent to that side. The wire extends another four inches beyond the pivot 13 to a scale 12 calibrated in wire movement in inches. A weight 16 is attached to the free end of the yarn just sufficient to overcome the friction of the pivot and pulley and to straighten that portion of the yarn which extends across the frame opening from one side of the frame to the opposing side. The tip of a butane flame from a cigarette lighter, not shown, is applied uniformly to the yarn in the frame opening. As the yarn elongates, the wire pivots to give a reading of yarn growth (elongation) on a calibrated scale. Percent growth is equal to yarn growth divided by the yarn length from the fixed point to the wire multiplied by one hundred.

The Thermal Protective Performance (TPP) test as described in Fire Technology V. 13 N.1 Feb. 1977 is used to rate clothing materials with respect to the time it would take to inflict second degree burns at a particular thermal exposure.

The TPP test is modified slightly for a determination of whether a single fabric extends laterally upon exposure to the heat flux. For this modification, the fabric is mounted with a slight bend away from the heat source so that if there is lateral expansion, it will balloon away from the heat source still further. No calorimeter is employed. Suitable fabric will balloon within 3 seconds of exposure to the heat flux. It has also been noted that the ballooning increases with time of exposure, usually for up to about 10 or 12 seconds and then starts to recede in the direction of the original position.

EXAMPLE

A three-layer fabric is prepared consisting of a 7.2 oz/yd$^2$ plain woven shell fabric, a moisture barrier and a thermal liner. The shell fabric was made from spun yarn 16/2 cc. using 2 inch cut length, 1.5 dpf fiber. The yarn has 3.5 turns/inch. The fiber was sulfonated PPD-T with an inherent viscosity of about 2, a tenacity of about 4.8 gpd, and 6 to 8 mol % sulfur, as sulfonate groups. The yarn when tested for elongation as earlier described, exhibited an elongation of more than 4%. The woven shell fabric showed the ballooning effect, in the modified TPP test. The moisture barrier was Goretex (0.5 to 0.8 oz/yd$^2$) with a nonwoven MPD-I/PPD-T fiber substrate (2.7 oz/yd$^2$) and the thermal liner was three spunlaced (MPD-I/PPD-T, ½) 1.5 oz/yd$^2$ sheets quilted to a 3.2 oz/yd$^2$ MPD-I staple fiber scrim.

A sample of the three-layer fabric was tested for Thermal Protective Performance (TPP) along with a similar structure with a non-ballooning shell fabric. The time required for the TPP sensor to register a second-degree burn with the three-layer fabric of the invention was increased by 25% over a similar fabric (PPD-T/PBI Kombat® 750 shell fabric, same moisture barrier and thermal liner) that does not exhibit the ballooning effect. Firefighter turnout coats are made from the three-layered fabric with the shell fabric on the outside of the coat.

We claim:

1. An improved garment that offers protection against heat and flame made of a multi-layered fabric comprising, in order, a flame resistant outer shell, a moisture barrier and a thermal insulating liner, wherein the improvement comprises an outer shell comprising a fabric woven from an aramid fiber and attached to the moisture barrier so that the fabric is free for limited movement relative to the moisture barrier wherein the aramid fiber of the fabric elongates at least 1% in a flame and the fabric extends laterally and expands away from the moisture barrier within 3 seconds from exposure to a heat source of at least 1.8 cal/cm$^2$-seconds.

2. A garment according to claim 1 wherein the outer shell fabric is woven from spun yarn that has an L.O.I. greater than 20 and elongates in a butane flame.

3. A garment according to claim 1 wherein the outer shell is woven from a spun yarn of sulfonated poly(p-phenylene terephthalamide) fiber having an inherent viscosity of about 1.5 to 4 and which contains from 5 to 20 mols of sulfur, as sulfonate groups, per 100 mols of polymer repeat units.

4. A garment according to claim 1 wherein the outer shell fabric has a basis weight of from about 4 to 8 oz/yd$^2$.

5. An improved multi-layered fabric for use in garments designed to offer protection against heat and flame comprising, in order, a flame resistant layer, a moisture barrier layer and a thermal insulating liner layer wherein the improvement comprises a flame resistant layer comprising a fabric woven from an aramid fiber and attached to the moisture barrier so that the fabric is free for limited movement relative to the moisture barrier wherein the aramid fiber of the fabric elongates at least 1% in a flame and the fabric extends laterally and expands away from the moisture barrier layer within 3 seconds after exposure to a heat source of at least 1.8 cal/cm$^2$-seconds.

6. The fabric according to claim 5 wherein the outer shell fabric is woven from spun yarn.

7. The fabric according to claim 5 wherein the aramid fiber is a spun yarn of sulfonated poly(p-phenylene terephthalamide) fiber having an inherent viscosity of about 1.5 to 4 and which contains from 5 to 20 mols of sulfur, as sulfonate groups, per 100 mols of polymer repeat units.

8. The combination of an outer shell fabric for use in multi-layered garments designed to offer protection against heat and flame and at least one adjacent layer to which the outer shell is attached wherein the improvement comprises weaving the outer shell from a spun yarn of an aramid fiber of sulfonated poly(p-phenylene terephthalamide) having an inherent viscosity of about 1.5 to 4 and which contains from 5 to 20 mols of sulfur, as sulfonate groups, per 100 mols of polymer repeat units and attaching the outer layer to the adjacent layer such that the shell is free for limited movement relative to the adjacent layer such that the outer layer extends laterally and expands away from the adjacent layer within 3 seconds after exposure to a heat source of at least 1.8 cal/cm$^2$-seconds and provides a 25% increase in the time to a second degree burn in Thermal Protective Performance testing compared to a similar layered fabric having an outer shell of a blend of poly(p-phenylene terephthalamide) and polybenzimidazole.

* * * * *